US005148744A

United States Patent [19]

Chiang

[11] Patent Number: 5,148,744

[45] Date of Patent: Sep. 22, 1992

[54] MICRO-CURVATURE ADJUSTABLE DEVICE FOR CURVE SCREEN PRINTING PRESSES AND IRONING PRESSES

[76] Inventor: Trong C. Chiang, P.O. Box 82-144, Taipei, Taiwan

[21] Appl. No.: 766,217

[22] Filed: Sep. 27, 1991

[51] Int. Cl.[5] ..... B41F 15/14; B41M 1/12

[52] U.S. Cl. ..... 101/124; 101/129

[58] Field of Search ..... 101/114, 115, 116, 119, 101/120, 124, 129

[56] References Cited

U.S. PATENT DOCUMENTS 4,380,955 4/1983 Okura ..... 101/115 X 4,637,308 1/1987 Vidoni ..... 101/114

*Primary Examiner*—Edgar S. Burr

*Assistant Examiner*—Moshe I. Cohen

*Attorney, Agent, or Firm*—Morton J. Rosenberg; David I. Klein

[57] ABSTRACT

This invention relates to a micro-curvature adjustable device for curve screen printing presses and ironing presses and in particular to one including an upper cover provided with a tool post in a front side and an adjusting mechanism on an upper surface, an oscillating plate mounted below the upper cover and having a front seat, a horizontal sliding block for passage of a shaft, and a pair of clamping arms in the front side, an oscillating arm arranged on the upper cover and connected with a front linking block, a downward oscillating block and a rear linking block, a rear connecting arm mounted under the upper cover and having a rear horizontal groove and a plurality of rear vertical sliding blocks in an inner side, an axle seat arranged between the front connecting plate and the rear connecting plate and having a pivoted gear engaged with a front toothed rack and a rear toothed rack, a front connecting plate provided with a front horizontal groove and a plurality of vertical sliding blocks at an inner side, and an eccentric disc with an adjusting slot pivotally connected with a guiding arm connected with the linking plate at the other end, whereby the printing amplitude as well as the printing curvature may be easily and conveniently adjusted as required.

1 Claim, 6 Drawing Sheets

MICRO-CURVATURE ADJUSTABLE DEVICE FOR CURVE SCREEN PRINTING PRESSES AND IRONING PRESSES

BACKGROUND OF THE INVENTION

It is found that the adjustment of the screen printing press and the ironing press in printing amplitude and printing curvature is as follows:

1. It is necessary to replace the curvature gear for the adjustment.
2. It is time-consuming for the adjustment.
3. It requires a lot of labor when desired to adjust the printing amplitude and printing curvature.
4. It is difficult to carry out the adjustment accurately.
5. It is inconvenient for the adjustment.

Therefore, it is an object of the present invention to provide a micro-curvature adjustable device for curve screen printing presses and ironing presses which may obviate and mitigate the above-mentioned drawbacks.

SUMMARY OF THE INVENTION

This invention relates to a micro-curvature adjustable device for curve screen printing presses and ironing presses.

It is the primary object of the present invention to provide a micro-curvature adjustable device for curve screen printing presses and ironing presses which may facilitate the adjustment of the printing width.

It is another object of the present invention to provide a micro-curvature adjustable device for curve screen printing presses and ironing presses which is easy to operate.

It is still another object of the present invention to provide a micro-curvature adjustable device for curve screen printing presses and ironing presses which is simple in construction.

It is still another object of the present invention to provide a micro-curvature adjustable device for curve screen printing presses and ironing presses which is economical to produce.

It is a further object of the present invention to provide a micro-curvature adjustable device for curve screen printing presses and ironing presses which is fit for mass production.

Other objects and merits and a fuller understanding of the present invention will be obtained by those having ordinary skill in the art when the following detailed description of the present invention is read in conjunction with the accompanying drawings.

DETAILED DESCRIPTION OF THE PREFERRED EMBODIMENT

Figure 1:
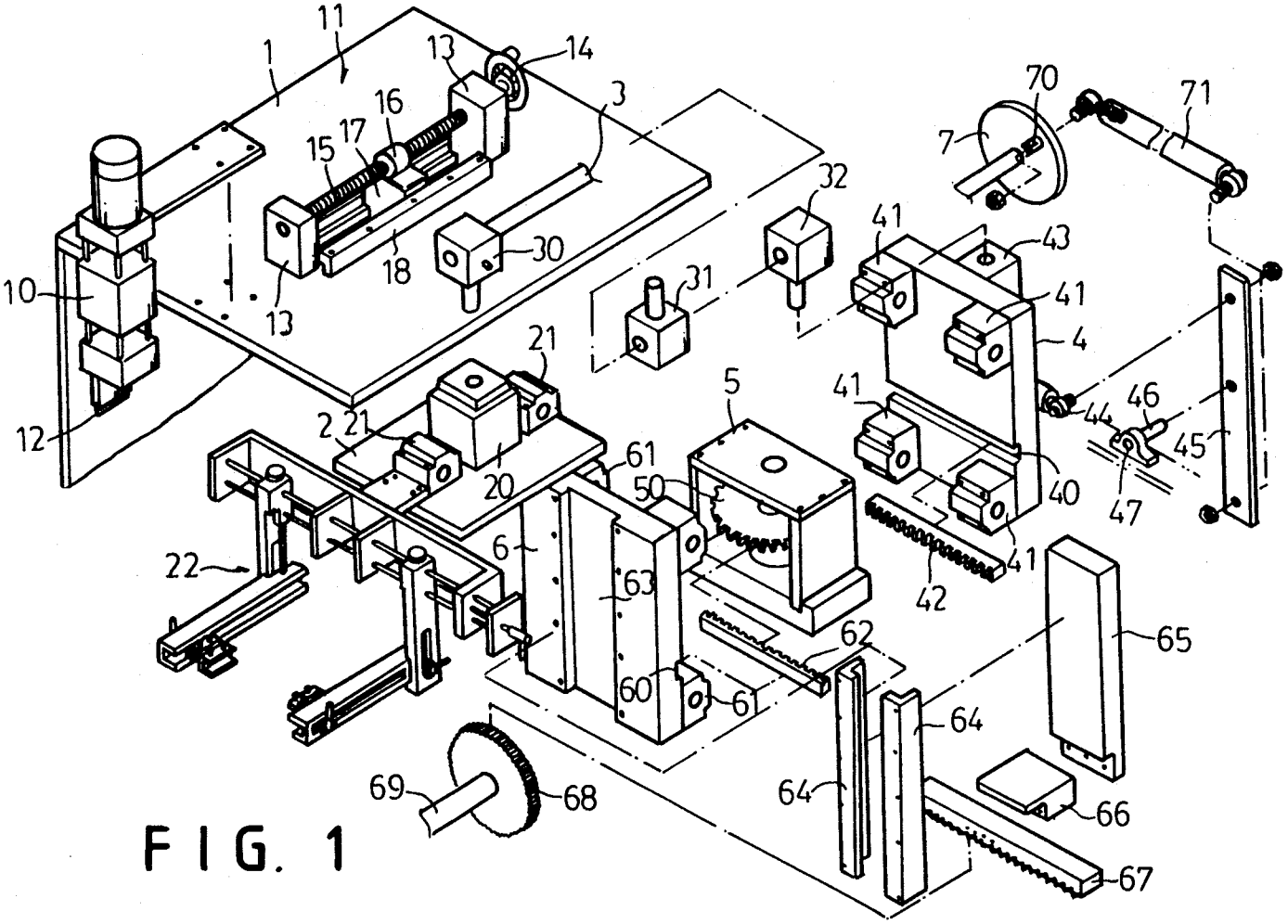
FIG. 1 is an exploded view of the present invention.
Figure 2:
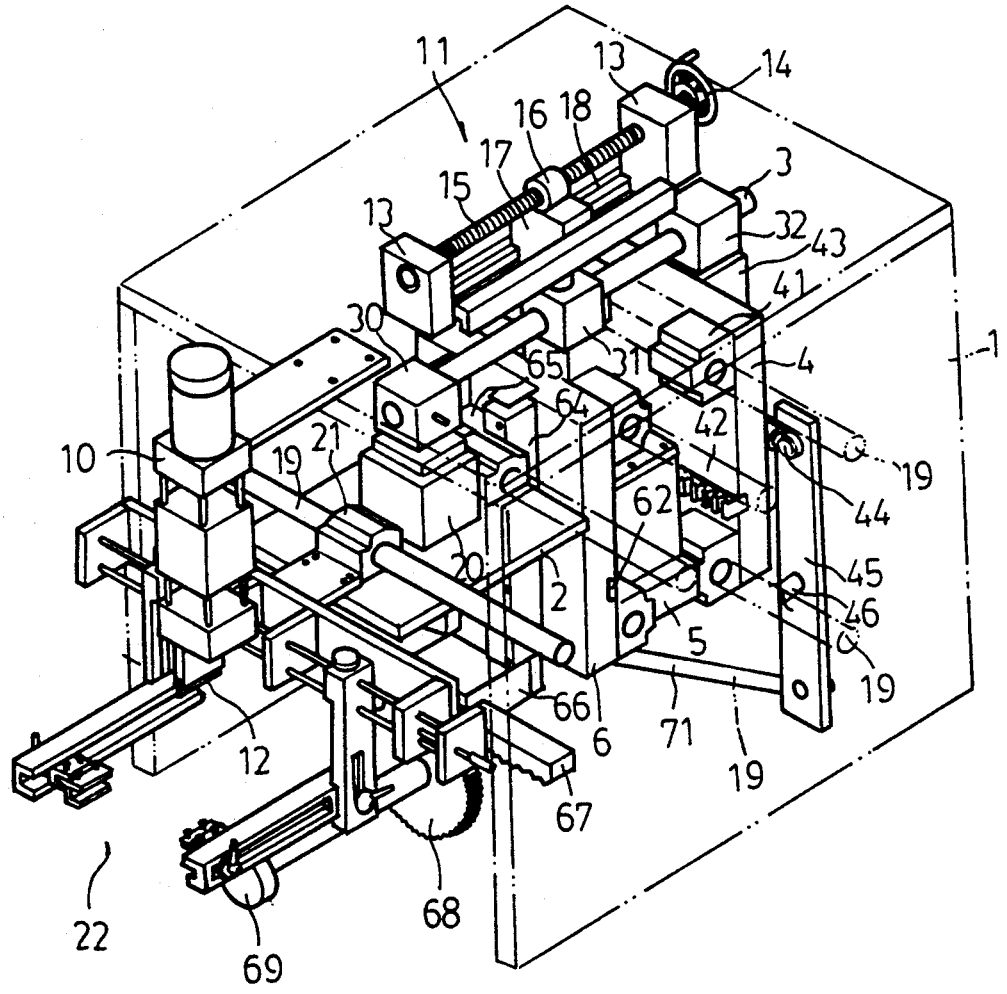
FIG. 2 is a perspective view of the present invention.
Figure 3A:
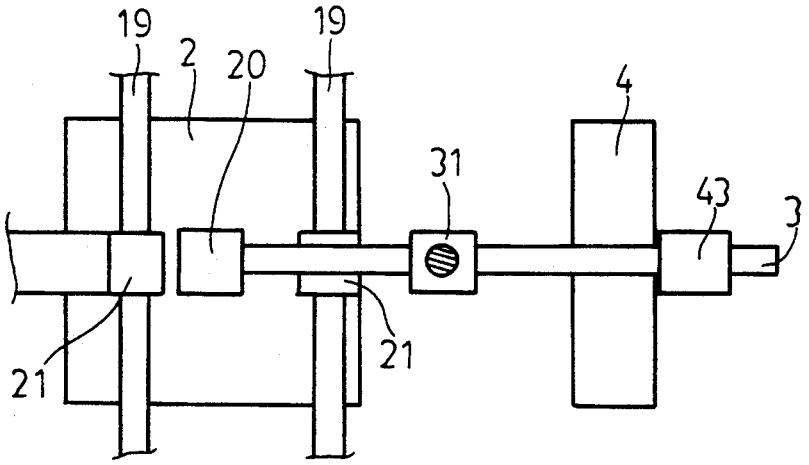
FIGS. 3A, 3B and 3C show how the oscillating plate is moved by the oscillating rod.
Figure 3B:
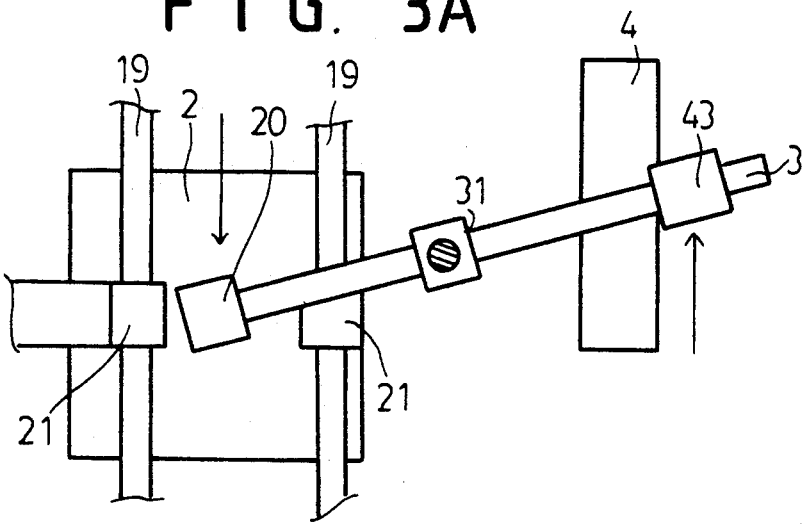
Figure 3C:
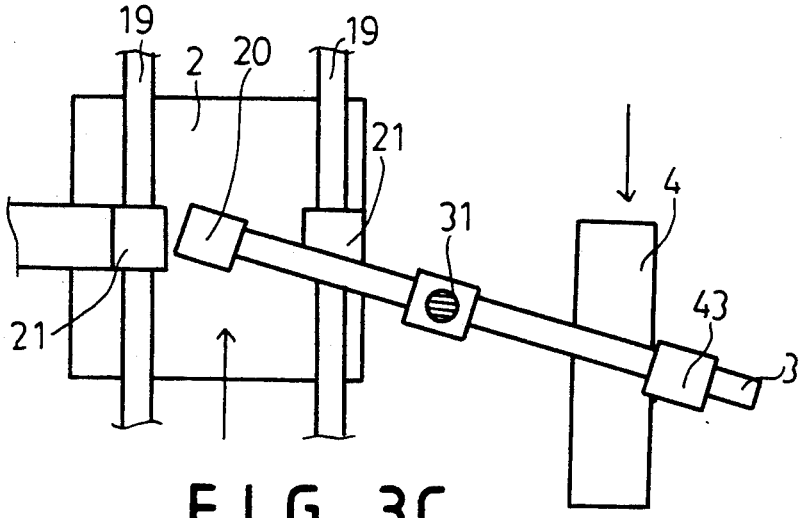
Figure 4C:
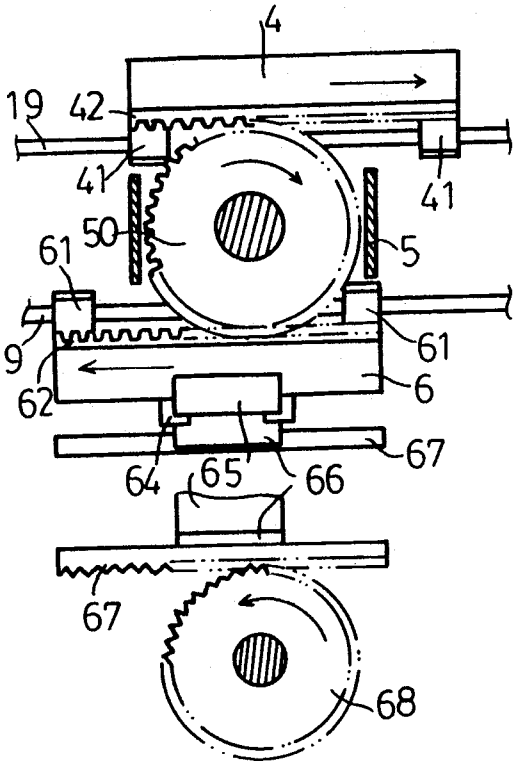
FIGS. 4A, 4B and 4C show the working principle of the front rack, rear rack and the axial gear.
Figure 4B:
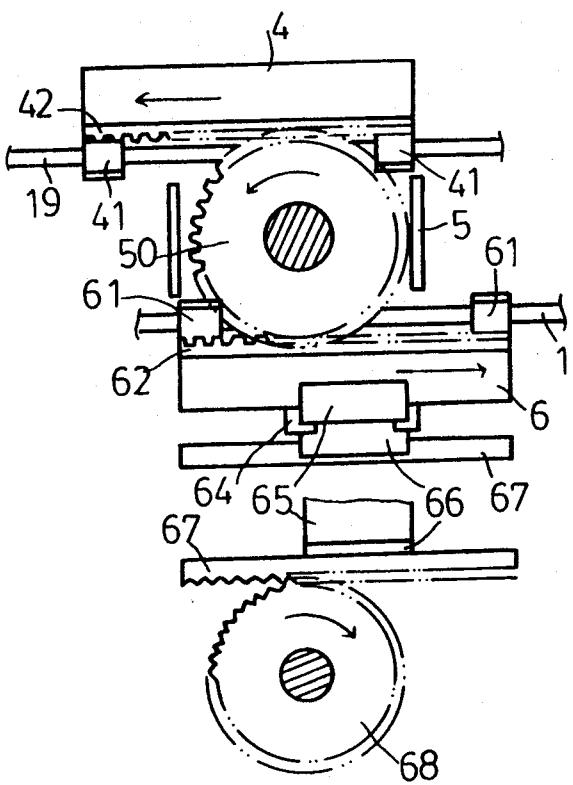
Figure 4A:
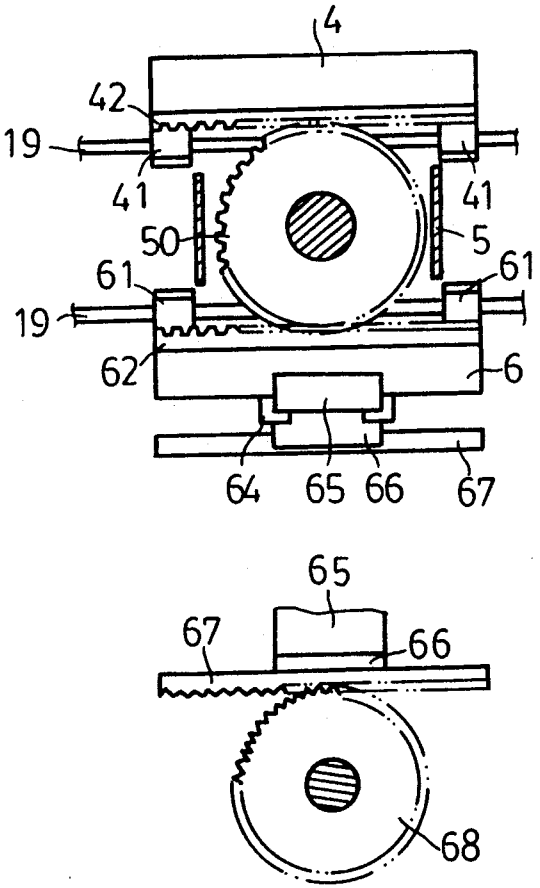
Figure 5A:
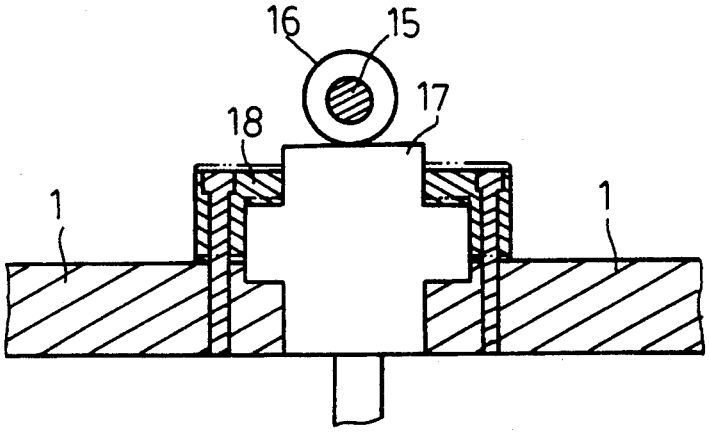
FIGS. 5A and 5B show how the adjusting mechanism adjusts the axial distance of the oscillating rod.
Figure 5B:
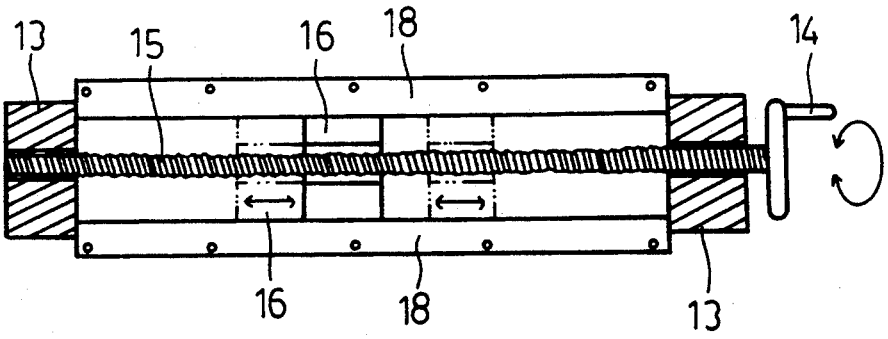
Figure 6A:
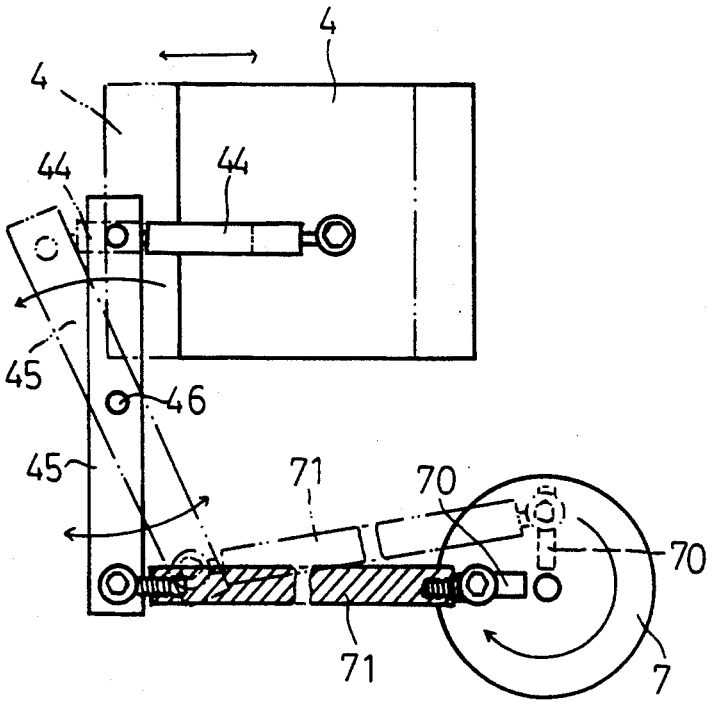
FIGS. 6A and 6B show the principle of the power transmission and the adjustment of the oscillating amplitude.
Figure 6B:
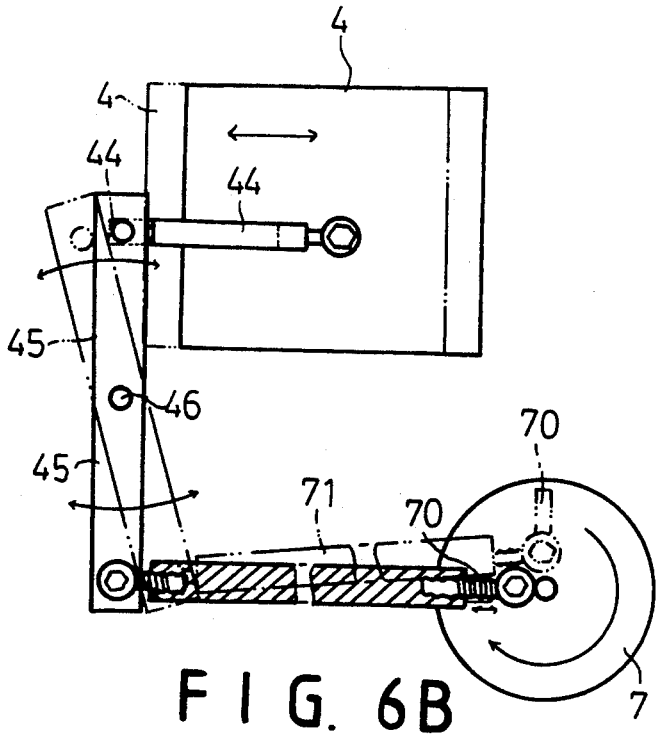

With reference to the drawings and in particular to FIGS. 1 and 2 thereof, the present invention comprises an upper cover 1 provided with a tool post 10 in the front side and an adjusting mechanism 11 on the upper surface. The tool post 10 is designed for receiving a scraper 12 while the adjusting mechanism 11 has two supports 13 between which is pivotally mounted a screw 15 with a hand wheel 14 at one end. The screw 15 is engaged with a threaded sleeve 16 on which there is an upward oscillating block 17 movable with respect to the corresponding racks 18. Further, there are a plurality of shafts 19 under the upper cover 1.

An oscillating plate 2 is mounted below the upper cover 1, which has a front seat 20 and a horizontal sliding block 21 for the passage of a shaft 19. Further, there is a pair of clamping arms 22 in the front of the oscillating plate 2.

An oscillating arm 3 is arranged on the upper cover 1 and is connected with a front linking block 30, a downward oscillating block 31 and a rear linking block 32. The front linking block 30 is pivotally connected with the front seat 20 while the downward oscillating block 31 is connected with an upward oscillating block 17.

A rear connecting plate 4 is mounted under the upper cover 1 and has a rear horizontal groove 40 and a plurality of rear vertical sliding blocks 41 in the inner side. The rear horizontal groove 40 is designed to engage with a rear toothed rack 42, while the rear vertical sliding block 41 is connected with the shaft 19. Further, the rear connecting plate 4 is provided with a seat 43 and a guiding rod 44 in the front, the former being pivotally connected with the rear linking block 32 while the latter pivotally connected with a rear connecting plate seat 47 which is in turn pivotally connected with a linking plate 45 via an axle 46.

An axle seat 5 is arranged between the front connecting plate 6 and the rear connecting plate 4 and has a pivoted gear 50 engaged with a front toothed rack 62 and a rear toothed rack 42.

The front connecting plate 6 is provided with a front horizontal groove 60 and a plurality of vertical sliding blocks 61 at the inner side. The front horizontal groove 60 is engaged with the front toothed rack 62 while the front vertical sliding block 61 receives the shaft 19. Moreover, the outer side of the front connecting plate 6 has a vertical recess 63 threadedly engaged with two positioning clamping members 64 for receiving a vertical panel 65. The bottom of the vertical panel 65 is provided with a pivoted block 66 which is connected with a lower toothed rack 67 engaged with a gear 68. In addition, the gear 68 is connected with a shaft 69 at the center.

An eccentric disc 7 with an adjusting slot 70 is pivotally connected with a guiding arm 71 which is in turn connected with the linking plate at the other end.

When in use (see FIGS. 2 through 6), the power is first turned on to rotate the eccentric disc 7. Then, the guiding arm 71 of the eccentric disc 7 will push the linking plate 45 to rotate about the axle 46. Thereafter, the guiding rod 44 will move the rear connecting plate 4 to move along the shaft 19. Meanwhile, the rear rack 42 will move the front rack 62 in an opposite direction via the gear 50 thereby causing the front connecting plate 6 to move the gear 68 through the lower rack 67 and therefore, rotating the shaft 69. At that time, the movement of the rear connecting plate 4 will move the oscillating arm 3 to rotate about the downward oscillating block 31 thereby moving the oscillating plate 2 in an opposite direction and therefore, making the clamping arms 22 hold up the printing board and go through the scraper 12 and the printing container on the shaft 69 hence producing the curved screen. As to the ironing process, it is only necessary to replace the scraper 12 with the ironing equipment.

Conclusively, the present invention has the following characteristics:

1. The transverse amplitude of the rear connecting plate 4 is simply adjusted by changing the connecting position between the guiding arm and the slot 70 of the eccentric disc 7. Hence, the rear rack 42 will move the front connecting plate 6 in an opposite direction and at the same amplitude via the gear 50 and the front rack 62. Then, the lower rack 67 and the gear 68 will drive the shaft 69 to rotate through an amplitude adapted to the printing board gripped by the clamping arms 22.

2. When the hand wheel 14 is rotated to turn the screw 15, the screw 15 will move the threaded sleeve 16 together with the upward oscillating block 17 along the rack 18 thereby moving the downward oscillating block 31 along the oscillating arm 3. Hence, the transverse amplitude of the oscillating plate 2 may adapt to the gear 68 and the curvature of the printing matter on the shaft 69.

However, it should be noted that when both the gear 68 and the printing container are 135 mm in diameter, then the upward oscillating block 17 is adjusted to locate at the center of the front seat 20 and the rear seat 43 such that the displacement of the screen and the printing container may move synchronously. Further, in case the gear 68 is 135 mm while the printing container is 150 mm in diameter, the upward oscillating block 17 must be adjusted to move away from the center of the front seat 20 and the rear seat 43 thereby moving the displacement of the screen and the printing container sychronously.

As stated above, it is only necessary to adjust the connecting position between the guiding arm 71 and the slot 70 of the eccentric disc 7 to adapt to the printing amplitude. In addition, the printing curvature may be conveniently adjusted by turning the hand wheel 14.

Although the present invention has been described with a certain degree of particularity, it is understood that the present disclosure is made by way of example only and that numerous changes in the detail of construction and the combination and arrangement of parts may be resorted to without departing from the spirit and scope of the invention as hereinafter claimed.

I claim:

1. A micro-curvature adjustable device for curve screen printing presses and ironing presses comprising:

an upper cover provided with a tool post mounted on a front side and an adjusting mechanism on an upper surface, said tool post being designed for receiving a scraper, said adjusting mechanism having two supports between which is pivotally mounted a screw with a hand wheel at one end, a threaded sleeve, a plurality of racks. said screw being engaged with said threaded sleeve, an upward oscillating block movable with respect to corresponding ones of said racks located on said threaded sleeve, a plurality of shafts mounted below said upper cover;

an oscillating plate mounted below said upper cover and having a front seat, a horizontal sliding block for passage of a shaft, and a pair of clamping arms located on the front side;

a front linking block, a downward oscillating block, and a rear linking block an oscillating arm arranged on said upper cover and connected with said front linking block, said downward oscillating block and said rear linking block, said front linking block being pivotally connected to said front seat, said downward oscillating block being connected with said upward oscillating block;

a rear connecting plate mounted under said upper cover and having a rear horizontal groove and a plurality of rear vertical sliding blocks located on an inner side, a rear toothed rack, said rear horizontal groove engaging said rear toothed rack while said rear vertical sliding blocks are connected with one of said shafts, a linking plate and an axle, said rear connecting plate being provided with a seat and a guiding rod on a front side such that said seat is pivotally connected with said rear linking block while said guiding rod is pivotally connected with said rear connecting plate seat which is in turn pivotally connected with said linking plate via said axle;

a front connecting plate, an axle seat located between said front connecting plate and said rear connecting plate and having a pivoted gear engaged with a front toothed rack and said rear toothed rack;

said front connecting plate being provided with a front horizontal groove and a plurality of vertical sliding blocks on an inner side, said front horizontal groove being engaged with said front toothed rack while the front vertical sliding block receives said shaft, two positioning clamping members, an outer side of said front connecting plate having a vertical recess threadedly engaged with said two positioning clamping members for receiving a vertical panel, said vertical panel being provided at a bottom with a pivoted block connected with a lower toothed rack engaged to a gear which is in turn connected with a shaft at the center; a guiding arm, and an eccentric disc with an adjusting slot being pivotally connected with said guiding arm which is in turn connected with said linking plate at the other end.

* * * * *